US007528855B2

(12) United States Patent
Namba

(10) Patent No.: US 7,528,855 B2
(45) Date of Patent: May 5, 2009

(54) LIGHT SCANNING DEVICE, AND IMAGE FORMING APPARATUS USING THE LIGHT SCANNING DEVICE

(75) Inventor: Masanori Namba, Koto-ku (JP)

(73) Assignee: Ricoh Company Limited, Tokyo (JP)

( * ) Notice: Subject to any disclaimer, the term of this patent is extended or adjusted under 35 U.S.C. 154(b) by 174 days.

(21) Appl. No.: 11/492,882

(22) Filed: Jul. 26, 2006

(65) Prior Publication Data

US 2007/0024943 A1 Feb. 1, 2007

(30) Foreign Application Priority Data

Jul. 28, 2005 (JP) ..... 2005-218852

(51) Int. Cl.
*B41J 15/14* (2006.01)
*B41J 27/00* (2006.01)

(52) U.S. Cl. ..... 347/241; 347/256

(58) Field of Classification Search ..... 347/241–242, 347/256–257, 134, 136; 399/175, 198, 98
See application file for complete search history.

(56) References Cited

U.S. PATENT DOCUMENTS 6,285,848 B1 * 9/2001 Aita et al. ..... 399/175
7,203,444 B2 * 4/2007 Yamazaki ..... 399/98
7,352,377 B2 * 4/2008 Matsutomo ..... 347/136
2005/0012973 A1 * 1/2005 Sowa et al. ..... 359/198
2006/0001980 A1 1/2006 Namba

FOREIGN PATENT DOCUMENTS

| | | | |
|---|---|---|---|
| JP | 9-80875 | | 3/1997 |
| JP | 09080875 A | * | 3/1997 |
| JP | 3283664 | | 3/2002 |
| JP | 2002-127495 | | 5/2002 |
| JP | 2002-267983 | | 9/2002 |
| JP | 2004-17607 | | 1/2004 |

* cited by examiner

*Primary Examiner*—Hai C Pham
(74) *Attorney, Agent, or Firm*—Oblon, Spivak, McClelland, Maier & Neustadt, P.C.

(57) ABSTRACT

A light scanning device for performing laser beam scanning, which includes a polygon scanner configured to deflect a laser beam; an optical device configured to guide the deflected laser beam; a case in which the polygon scanner and the optical device are arranged; a transparent covering member which is provided on the case to cover an opening and which transmits the laser beam to perform laser beam scanning; and a cleaner which is detachably attached to the light scanning device and which includes an elastic cleaning member on one side of a body of the cleaner for cleaning a surface of the transparent covering member, wherein the body of the cleaner has a recessed portion on the one side thereof.

12 Claims, 9 Drawing Sheets

LIGHT SCANNING DEVICE, AND IMAGE FORMING APPARATUS USING THE LIGHT SCANNING DEVICE

BACKGROUND OF THE INVENTION

1. Field of the Invention

The present invention relates to a light scanning device which writes an electrostatic image on an image bearing member, and more particularly to a light scanning device which writes an electrostatic image on an image bearing member by scanning an image bearing member with a light beam deflected by a light deflector.

2. Discussion of the Background

Image writing sections of image forming apparatuses such as digital copiers, printers and facsimile machines include an optical image writing unit (i.e., a light scanning device) which scans an image bearing member such as photoreceptors with a light beam, which is modulated according to image signals and which is deflected by a light deflector and passes through an optical device, to form an electrostatic image on the image bearing member. The thus formed electrostatic image is developed with a developer including a toner to form a toner image on the image bearing member.

Recently, a need exists for an image forming apparatus, which can produce high quality images, and therefore, a need exists for a light scanning device, which can write an optical image with high resolution. Light scanning devices typically emit a laser light beam through a transparent covering member covering a light irradiation opening (e.g., dust-proof glass plates), which is provided to prevent dust from entering the light scanning devices. When toner particles and dust (such as paper dust) are adhered to the transparent material, a problem in that transmission of a laser beam is worsened and thereby qualities of an electrostatic image formed on the image bearing member are deteriorated occurs.

On the other hand, a need exists for a small-sized image forming apparatus. Therefore, arrangement of a light scanning device in image forming apparatuses becomes diversified. For example, there is a case where a light scanning device is arranged so as to be on the same level in position as that of an image bearing member or to be located below an image bearing member. In this case, a problem in that toner particles used for developing an electrostatic image on the image bearing member are adhered to the transparent covering member easily occurs.

In attempting to solve the problem, published unexamined Japanese patent application No. 2002-267983 (hereinafter referred to as JP-A) discloses a technique in that a dust-protective cover is provided on the transparent dust-proof glass plate such that dust is not adhered to the dust proof glass plate. If dust is adhered to the glass plates, the dust-proof glass is cleaned after detaching the cover therefrom, and a technique in that a cleaning mechanism for cleaning the dust-proof glass is provided to remove dust adhered to the dust-proof glass with a cleaning pad thereof.

JP-As 2002-127495 and 09-80875 have disclosed a technique in that the transparent covering member (made of a glass plate) has a constitution so as to be detached from the light scanning device, and a technique in that a slidable flame having a cleaning member is provided to clean the dust-proof glass.

Further, JP-As 2004-17607 and 07-128959 have disclosed a technique in that a bar cleaner having a pad thereon is provided or a technique in that a bar cleaner is provided on the case of a magazine of the image forming apparatus, and the surface of the transparent covering member is cleaned by the cleaner when the magazine is detached to be replaced.

However, recently in order to produce high quality images, a toner having a small average particle diameter is typically used and therefore the problem in that the transparent covering member of the light scanning device is contaminated with the toner is caused more frequently than ever. Particularly, spherical toner has poor cleaning property, i.e., spherical toner particles easily pass through a cleaning blade, resulting in increase of the amount of residual toner particles on an image bearing member. Therefore, the chance of contamination of a transparent covering member with residual toner particles is increased.

In addition, recently there is a tendency such that users perform maintenance of their image forming apparatus as much as they can. Therefore, the above-mentioned problem is easily caused.

Because of these reasons, a need exists for a light scanning device which can maintain good laser light emitting property over a long period of time by means of user's simple cleaning operation.

SUMMARY OF THE INVENTION

As a first aspect of the present invention, alight scanning device for performing laser beam scanning is provided which includes:

a polygon scanner configured to deflect a laser beam;

an optical device configured to guide the laser beam;

a case containing the polygon scanner and the optical device therein;

a transparent covering member which is provided on the case and which transmits the laser beam to perform laser beam scanning; and a cleaner which is detachably attached to the light scanning device and which has an elastic cleaning member on one side of a body thereof for cleaning the surface of the transparent covering member, wherein the cleaner has a recessed portion on the side thereof.

By forming such a recessed portion, occurrence of a problem in that dust adhered to the transparent covering member is adhered to the cleaner before the dust is removed to the elastic cleaning member and the dust is adhered again to the covering member can be prevented.

As another aspect of the present invention, an image forming apparatus is provided which includes:

an image bearing member configured to an electrostatic latent image thereon;

a light scanning device configured to scan the image bearing member with a laser beam to form the electrostatic latent image on the image bearing member;

a developing device configured to develop the electrostatic latent image with a developer including a toner to form a toner image on the image bearing member;

a transfer device configured to transfer the toner image onto a receiving material; and a fixing device configured to fix the toner image on the receiving material, wherein the light scanning device is the light scanning device mentioned above.

These and other objects, features and advantages of the present invention will become apparent upon consideration of the following description of the preferred embodiments of the present invention taken in conjunction with the accompanying drawings.

DETAILED DESCRIPTION OF THE INVENTION

The present invention will be explained referring to drawings.

Figure 1:
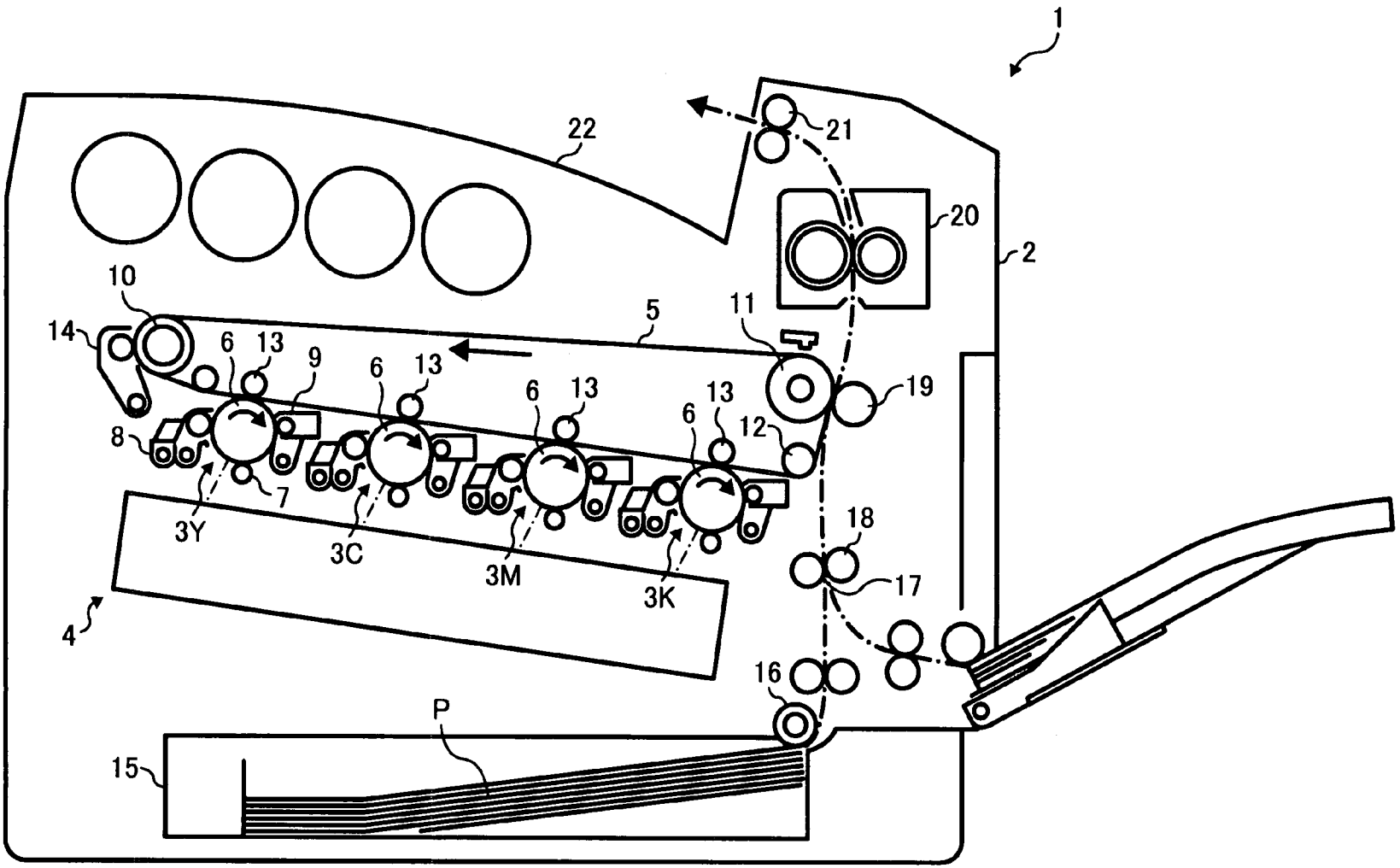
FIG. 1 is a schematic view illustrating an example of the image forming apparatus of the present invention.

FIG. 1 is a schematic view illustrating the cross section of an example of the image forming apparatus of the present invention, which is a color printer.

Referring to FIG. 1, a color printer 1 includes four printer engines 3 (3Y, 3C, 3M and 3K), a light scanning device 4 configured to emit light beams, and an intermediate transfer medium 5, which are set in a main body case 2. The printer engines 3Y, 3C, 3M and 3K form yellow, cyan, magenta and black color toner images using yellow, cyan, magenta and black color toners, respectively, and have the same configuration. The suffixes Y, C, M and K represent yellow, cyan, magenta and black colors, respectively, and are hereinafter sometimes omitted.

The four printer engines 3Y, 3C, 3M and 3K have the same mechanical structure. Each of the printer engines 3 includes a photoreceptor 6 serving as an image bearing member, and a charger 7 configured to charge the photoreceptor 6, a developing device 8 configured to develop an electrostatic latent image on the photoreceptor 6 with a developer including a toner to form a toner image thereon, and a cleaner 9 configured to clean the surface of the photoreceptor 6, which are arranged around the photoreceptor 6.

The photoreceptor 6 has a drum-form, and is rotated by a driving device (not shown). The photoreceptor 6 has a photosensitive layer on the peripheral surface thereof. The charger 7 is an electroconductive roller. A charging bias is applied to the charger 7 from a power source (not shown). The charger charges the peripheral surface of the photoreceptor 6. A light beam emitted from the light scanning device 4 and modulated according to image data scans the peripheral surface of the photoreceptor 6, which has been charged with the charger 7, resulting in formation of an electrostatic latent image.

The developing device 8 supplies a toner to the photoreceptor 6. When the toner is adhered to the electrostatic latent image on the photoreceptor 6, the latent image is visualized as a toner image. In this example, the toner has a first shape factor SF-1 of from 100 to 150, and a second shape factor SF-2 of from 100 to 140.

Figure 2:
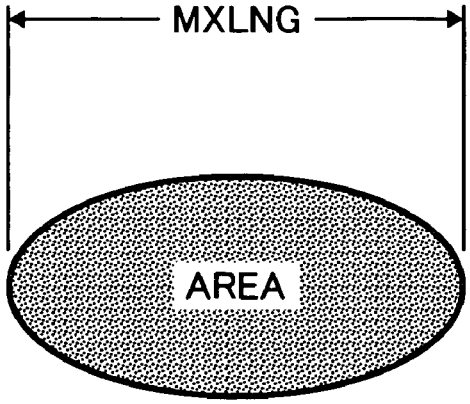
FIGS. 2 and 3 are schematic views for explaining the way to determine the shape factors SF-1 and SF-2 of toner.
Figure 3:
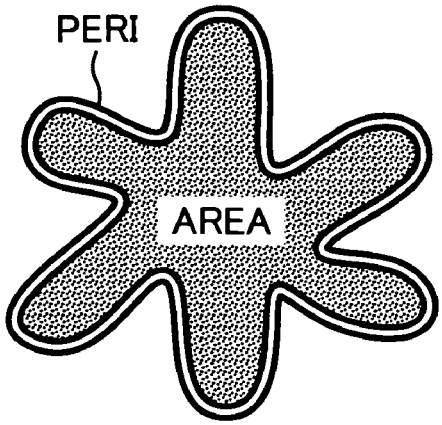

FIGS. 2 and 3 are schematic views for explaining the shape factors SF-1 and SF-2, respectively.

As illustrated in FIG. 2, the shape factor SF-1 represents the degree of the roundness of a toner and is defined by the following equation (1):

$$SF\text{-}1=\{(\mathrm{MXLNG})^2/(\mathrm{AREA})\}\times(100\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. In this case, the toner particles contact the other toner particles and a photoreceptor serving as an image bearing member at one point. Therefore, the adhesiveness of the toner particles to the other toner particles and the photoreceptor decreases, resulting in increase of the fluidity of the toner particles and the transferability of the toner. When the SF-1 is too large, the toner particles have irregular forms and thereby the toner has poor developability and poor transferability.

As illustrated in FIG. 3, the shape factor SF-2 represents the degree of the concavity and convexity of a toner particle, and is defined by the following equation (2):

$$SF\text{-}2=\{(\mathrm{PERI})^2/(\mathrm{AREA})\}\times(100/4\pi) \quad (2)$$

wherein PERI represents the peripheral length of the image of a toner particle observed by a microscope; and AREA represents the area of the image.

When the SF-2 approaches 100, the toner particles have a smooth surface (i.e., the toner has few concavity and convexity). It is preferable for a toner to have a slightly roughened surface because the toner has good cleanability. However, when the SF-2 is too large (i.e., the toner particles are seriously roughened), a toner scattering problem in that toner particles are scattered around a toner image is caused, resulting in deterioration of the toner image qualities.

The cleaner 9 removes toner particles remaining on the peripheral surface of the photoreceptor 6 even after a toner image formed on the photoreceptor 6 is transferred onto the intermediate transfer medium 5.

The intermediate transfer medium 5 is an endless belt made of a material such as resins and rubbers. Color toner images formed on the photoreceptors 6 are transferred to the intermediate transfer medium 5. The intermediate transfer medium 5 is rotated in a direction indicated by an arrow while stretched by rollers 10, 11 and 12. Four transfer rollers 13 are arranged so as to be contacted with the inner surface of the intermediate transfer medium 5 to well transfer the toner images on the photoreceptors 6 onto the intermediate transfer medium 5. Since the color toner images formed on the photoreceptors 6 are sequentially transferred onto the intermediate transfer medium 5, a full color image is formed on the intermediate transfer medium 5. A belt cleaner 14 is provided to remove toner particles and paper dust remaining on the surface of the intermediate transfer medium 5.

A paper cassette 15 is arranged below the printer engines 3 and the light scanning device 4. Sheets of a receiving material P are stocked in the paper cassette 15. An uppermost sheet of the receiving material P is fed toward the printer engines 3 by a feeding roller 16 while separated from the other sheets.

The sheet of the receiving material P is fed through a passage 17. Along the passage 17, a pair of registration rollers 18, a transfer roller 19, a fixing device 20, a pair of discharge rollers 21, etc., are provided.

The pair of registration rollers 18 are rollers which are intermittently rotated in exact timing with an image forming operation of the printer engines 3. Specifically, when the registration rollers 18 start to rotate, the sheet of the receiving material P, which has been fed to the registration rollers 18 and stopped thereat, is fed toward the transfer position, i.e., the nip between the intermediate transfer medium 5 and the transfer roller 19. The color toner image formed on the intermediate transfer medium 5 is transferred onto the sheet of the receiving material P at the nip.

The fixing device 20 melts and fixes the color toner image on the sheet of the receiving material P upon application of heat and pressure thereto. The sheet of the receiving material P bearing the toner image thereon (i.e., a copy of an image) is then discharged to a tray 22.

Figure 4:
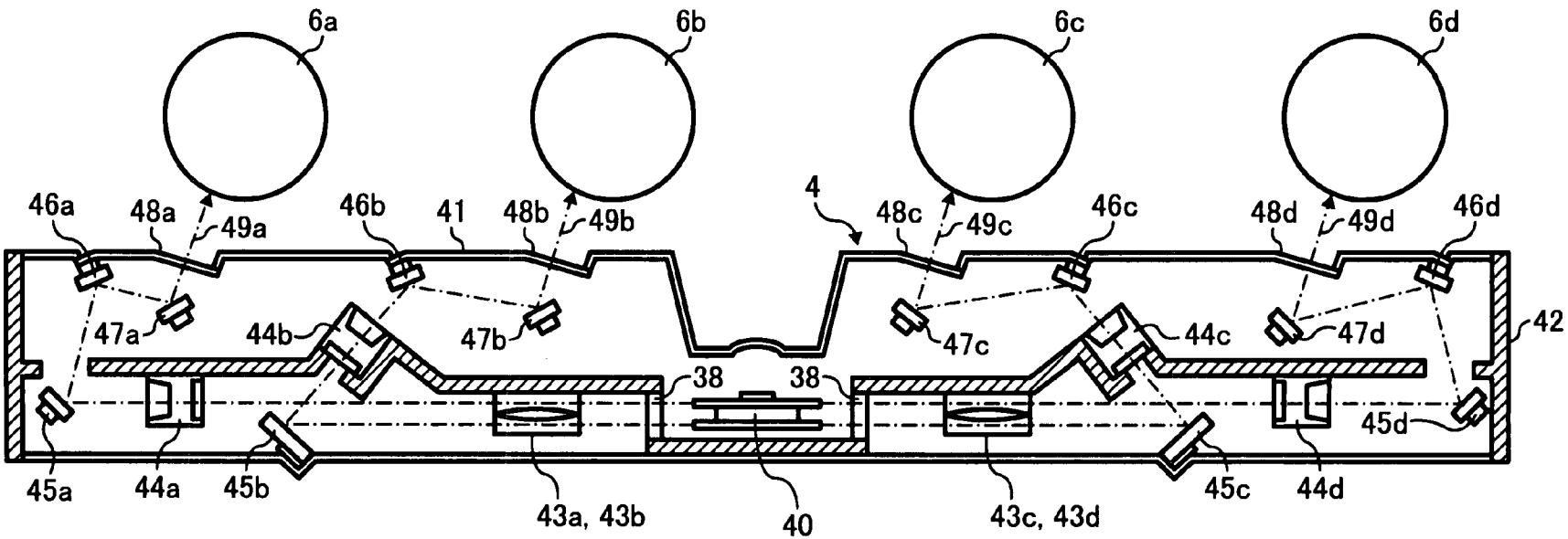
FIG. 4 is a schematic view illustrating an example of the light scanning device of the present invention, which is arranged in the vicinity of photoreceptors.
Figure 5:
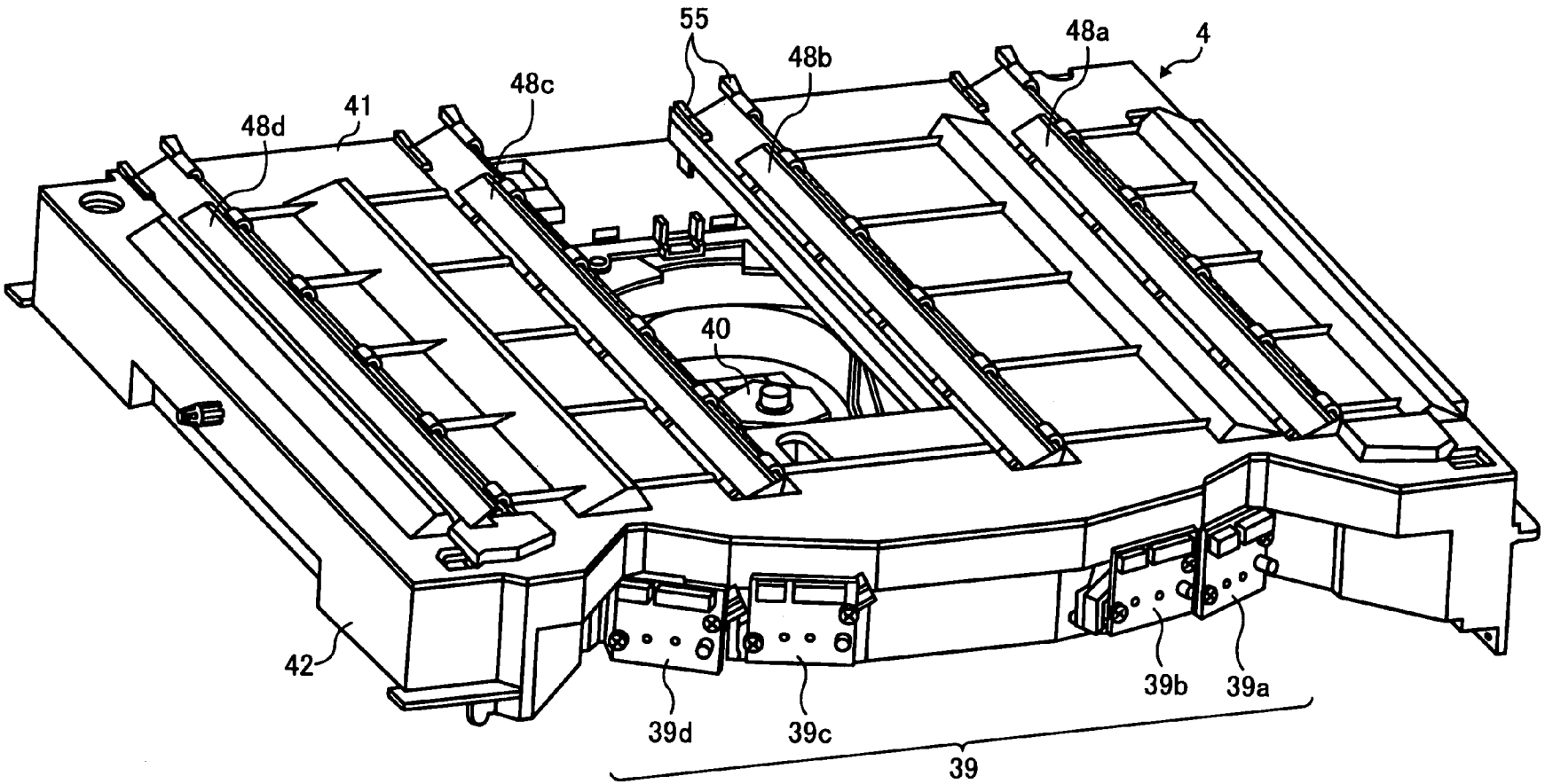
FIG. 5 is a schematic perspective view illustrating the light scanning device illustrated in FIG. 4.

FIG. 4 is a schematic view illustrating the cross section of the light scanning device 4. FIG. 5 is a schematic perspective view of the light scanning device 4. As illustrated in FIG. 4, the four photoreceptors 6*a*, 6*b*, 6*c* and 6*d* are provided in the vicinity of the light scanning device 4. For example, yellow, cyan, magenta and black toner images are formed on the photoreceptors 6*a*, 6*b*, 6*c* and 6*d*, respectively. However, the colors and color order are not limited thereto.

Needless to say, a charger (such as charging rollers, charging brushes and charging wires), a developing device, an intermediate transfer medium, a transfer device (such as transfer rollers and transfer brushes), a cleaner (such as cleaning blades and cleaning brushes) are provided around each of the photoreceptors 6*a*, 6*b*, 6*c* and 6*d* to form color images, but the devices are omitted in FIG. 4. The suffixes a, b, c and d represent colors of images. Since the configurations of the devices used for the four engines are the same, explanation is performed while the suffixes are sometimes omitted.

The light scanning device 4 is located below the four photoreceptors 6, and has four light sources 39*a*, 39*b*, 39*c* and 39*d*, each of which includes a laser diode; a light deflector which includes a polygon mirror 40 configured to symmetrically deflect four light beams emitted by the light sources 39 in opposite two directions, wherein since the polygon mirror 40 has upper and lower mirrors, the paths of the two light beams deflected in the same direction are different from each other; and a transmission/focusing optical device which includes a fθ lens 43, a focusing lens 44 and mirrors 45, 46 and 47, which are configured to guide and focus the light beams on the surfaces of the respective photoreceptors. These element is are set within the case of the light scanning device 4. In FIG. 4, numeral 49 denotes a light beam.

The light scanning device 4 has side walls 42 which is connected with a base plate supporting the transmission/focusing optical device and surrounds the transmission/focusing optical device. In addition, the base plate separates the upper portion from the lower portion of the light scanning device 4 as illustrated in FIG. 4. As illustrated in FIG. 5, the four light sources 39 are provided on the side wall. The polygon mirror 40 is arranged on a recessed portion of the base plate, which portion is located in substantially the center of the light scanning device 4. Thus, the light scanning device is closed. Therefore, the light scanning device has four laser light emitting openings (i.e., exits) on an upper case 41, on which four transparent dust-proof glass plates 48*a*, 48*b*, 48*c* and 48*d* are provided.

The light scanning device 4 converts image data, which are input from a document reader (not shown), or an image data output device such as personal computers, word processors, and receivers of facsimiles and which are subjected to a color separation treatment, to signals for driving the light sources, resulting in emission of light beams having image information. The thus emitted light beams are guided to the polygon mirror 40 to be deflected and scanned.

In FIG. 4, the polygon mirror 40 has two thin upper and lower mirrors, wherein the upper mirror deflects the light beams 49*a* and 49*d* for irradiating the photoreceptors 6*a* and 6*d*, and the lower mirror deflects the light beams 49*b* and 49*c* for irradiating the photoreceptors 6*b* and 6*c*. However, the polygon mirror is not limited thereto. For example, a polygon mirror having one mirror with large thickness in the axial direction thereof can also be used. Each of the thus deflected light beams pass through openings 38, the fθ lens 43 and the focusing lens 44, and is then reflected by the mirrors 45, 46 and 47. Then the light beam 49 passing through the dust-proof glass plate 48 scans the surface of the photoreceptor 6, resulting in formation of electrostatic latent images on the photoreceptors 6. The thus formed electrostatic latent images are developed with respective developers which is included in the developing devices 8 each including a color toner, resulting in formation of different color toner images on the respective photoreceptors 6. The toner images are transferred one by one to the intermediate transfer medium 5 by the transfer rollers 13. The thus overlaid color toner images are then transferred to the receiving material P at the same time. The multi-color toner image is then fixed by the fixing device 20, resulting information of a color copy.

Figure 6:
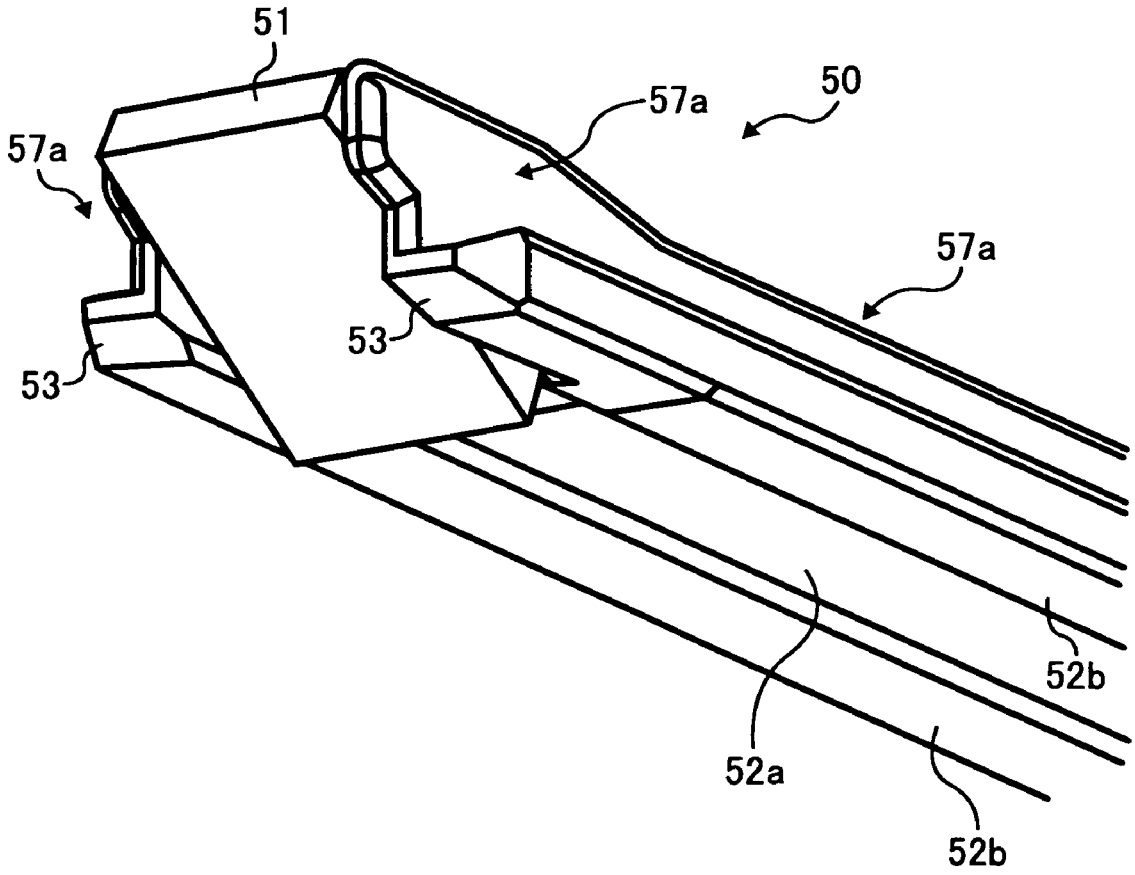
FIG. 6 is a schematic perspective view illustrating the tip portion of a cleaner for use in the light scanning device of the present invention.
Figure 7:
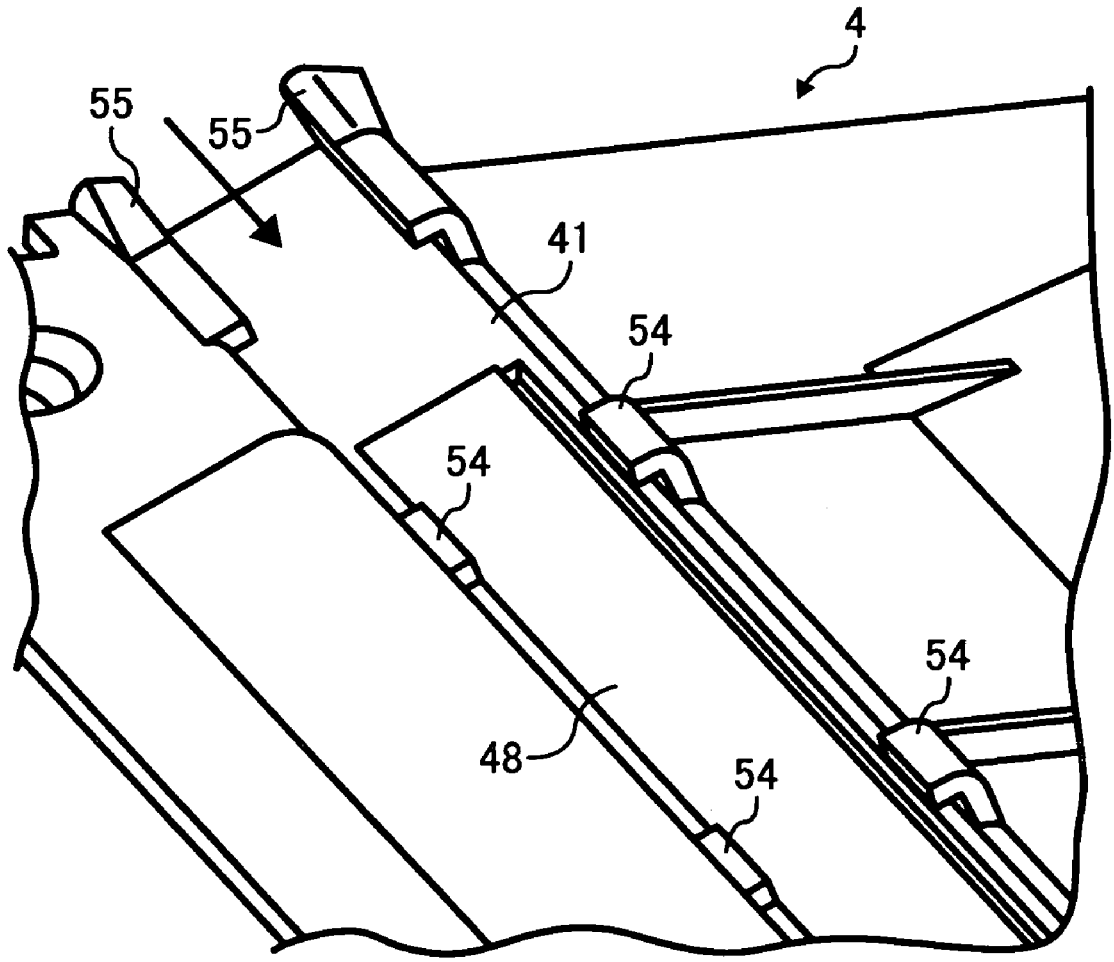
FIG. 7 is a schematic perspective view illustrating a portion of the case of the light scanning device, from which the cleaner is inserted.

FIG. 6 is an enlarged view illustrating the tip portion of the cleaner for cleaning the dust-proof glass plate 48. FIG. 7 is an enlarged view illustrating the portion of the light scanning device, from which the cleaner is inserted to clean the dust-proof glass plate 48. Referring to FIG. 6, a cleaner 50 includes a cleaning member 51, a recessed portion 52*a*, a projected portion 52*b*, and a guide 53. In FIG. 7, numeral 54 denotes an L-form guide for guiding the guide 53, and numeral 55 denotes an engaging portion which has substantially the same structure as the L-form guide 54 except that the height and width thereof are greater than those of the L-form guide 54 so that the guide 53 can be easily inserted thereinto.

Then the cleaning operation of the cleaner 50 for the dust-proof glass plate 48 will be explained. At first, the guide 53 of the cleaner 50 is engaged with the engaging portion 55 to be inserted thereinto. The cleaner 50 is then fed in a direction indicated by an arrow as illustrated in FIG. 7 while guided by the plurality of L-form guides 54, which are arranged at regular intervals. Thus, the surface of the dust-proof glass plate 48 is cleaned by the cleaning member 51. In this regard, since the length of the cleaner 50 is longer than that of the dust-proof glass plate 48, the entire surface of the dust-proof glass plate 48 can be subjected to the cleaning treatment.

Figure 8A:
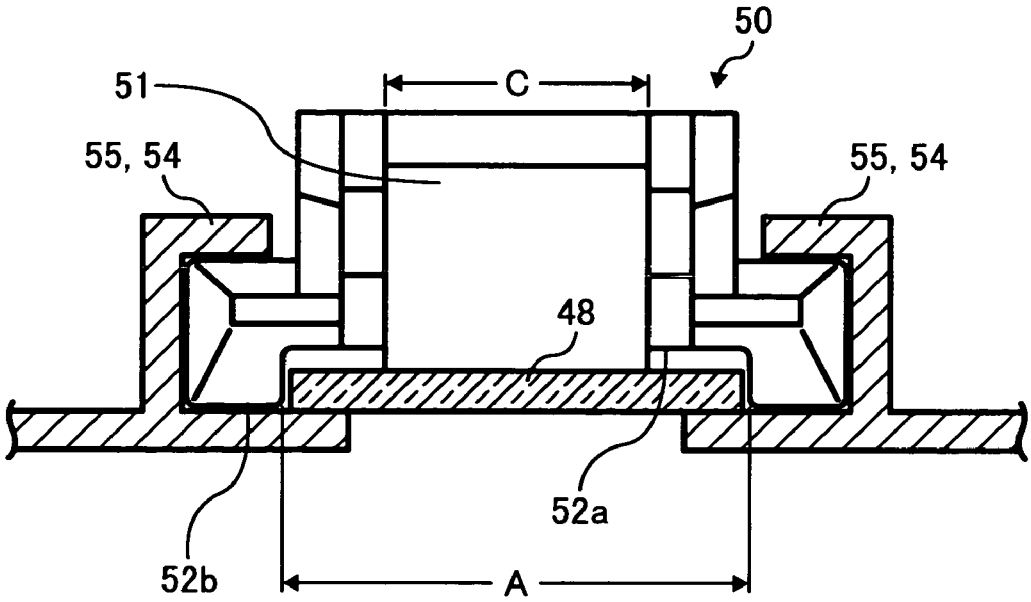
FIGS. 8A and 8B are schematic views illustrating the tip portions of cleaners for use in the present invention, which are set on the light scanning device.
Figure 8B:
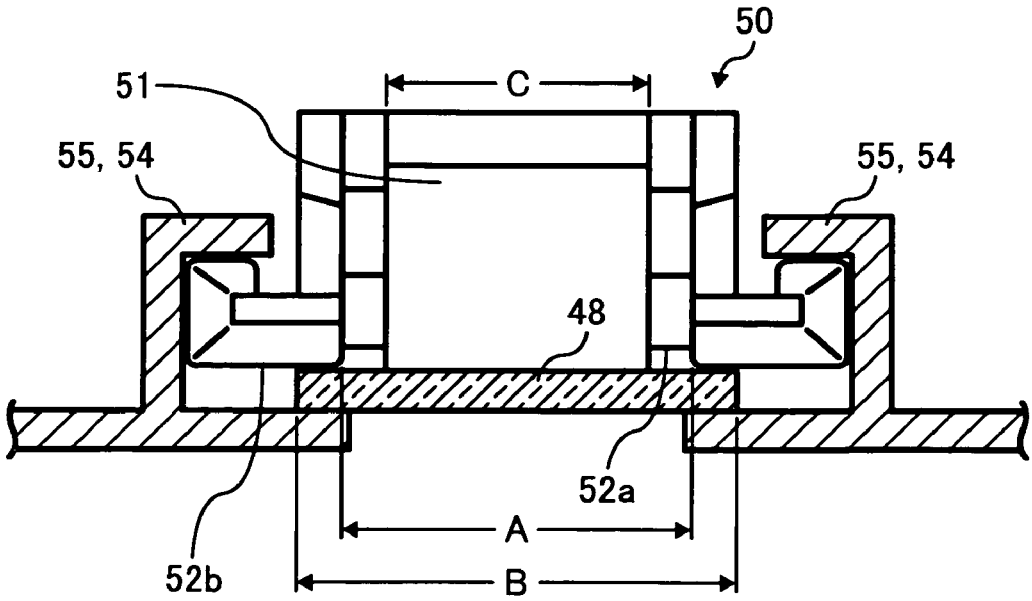

FIGS. 8A and 8B are schematic views illustrating examples of the tip portion of the cleaner, which is set above the dust proof glass plate 48. As illustrated in FIG. 8A, the cleaner is set such that the recessed portion 52*a* of the body thereof is not contacted with the surface of the glass plate 48. In addition, the recessed portion has a width (A) of longer than a width (C) of the cleaning member 51. In this cleaner 50, only the cleaning member 51 is contacted with the surface of the glass plate 48 to be cleaned, i.e., other portions of the cleaner 50 are prevented from contacting with the surface of the glass plate 48 to be cleaned. By using such a cleaner, occurrence of a problem in that dust on the surface of the glass plate 48 is adhered to other portions of the cleaner, and the dust is re-transferred to the surface of the glass plate 48 to be cleaned can be prevented.

As illustrated in FIG. 8B, the cleaner 50 may have a configuration such that the width (A) of the recessed portion is longer than the width (C) of the cleaning member 51 and shorter than a width (B) of the glass plate 48. In this cleaner 50, the surface of the projected portion 52*b* of the body of the cleaner is contacted with the surface of the glass plate 48, and therefore the position of the cleaning member 51 relative to the surface of the glass plate 48 can be well controlled. Therefore, the surface of the glass plate 48 can be uniformly and effectively cleaned.

Figure 9A:
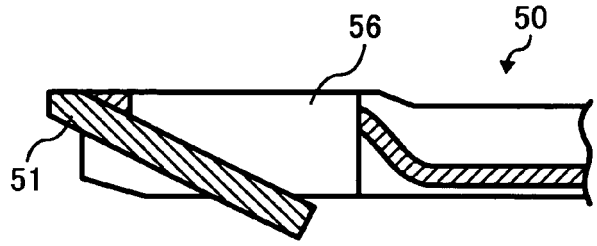
FIG. 9A is a schematic view illustrating the tip portion of the cleaner illustrated in FIG. 6, which is not set on the light scanning device.
Figure 9B:
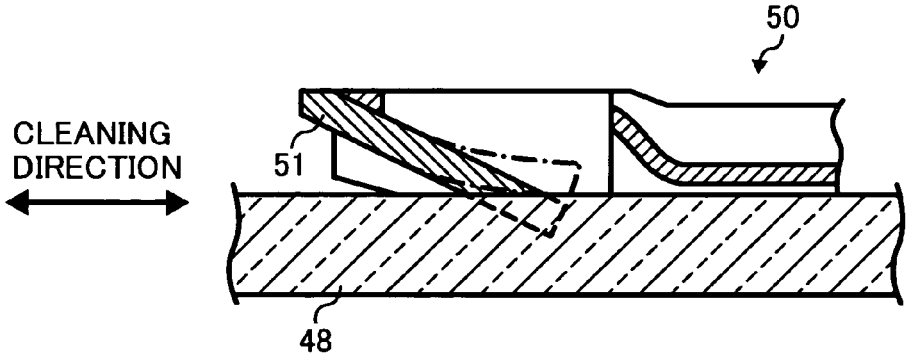
FIG. 9B is a schematic view illustrating the tip portion of the cleaner illustrated in FIG. 6, which is set on the light scanning device.

FIG. 9A is across section of the tip portion of the cleaning member 51 of the cleaner 50. FIG. 9B is a cross section of the tip portion when the cleaning member is contacted with the dust-proof glass plate 48 to clean the surface of the glass plate.

As illustrated in FIG. 9A, the cleaning member 51 is a blade made of an elastic material such as felt, sponge and rubbers (such as polyurethane rubbers). One end of the cleaning member 51 is fixed to the body of the cleaner 50 so as to be slanted at an angle of from 20 to 30° relative to the surface of the glass plate 48. In addition, as illustrated in FIG. 9B, the cleaner 50 has a space 56. When the cleaning member 51 is contacted with the surface of the glass plate 48, the cleaning member 51 is deformed so as to enter into the space 56 (i.e., to be stored in the space 56 without contacted with other portions of the cleaner) as illustrated in FIG. 9B. Therefore, the cleaning member 51 can be contacted with the surface of the glass plate 48 at substantially a constant pressure, and thereby the surface of the glass plate 48 can be well cleaned without causing uneven cleaning due to irregular deformation of the blade.

Figure 10:
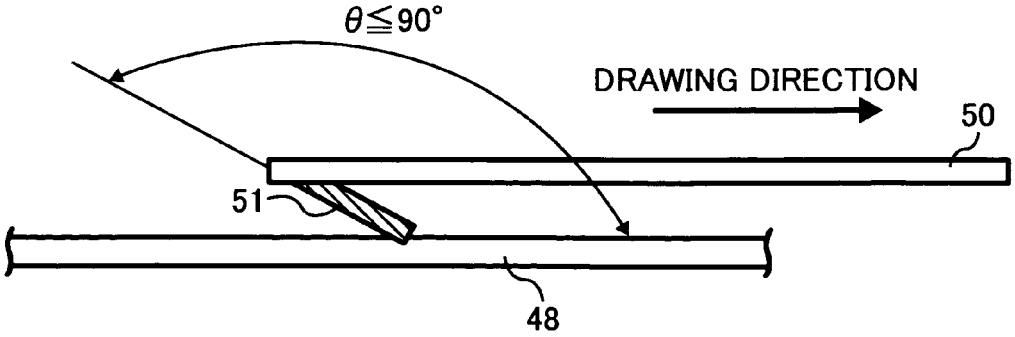
FIG. 10 is a schematic view for explaining how a cleaner for use in the present invention cleans the surface of the light scanning device.

FIG. 10 is a schematic view for explaining the angle of the cleaning member 51 when the cleaning member is contacted with the glass plate 48. When the cleaner 50 is moved in a drawing direction to be drawn from the light scanning device 4, the angle formed by the upper surface of the cleaning member 51 and the upper surface of the dust-proof glass plate 48 is preferably greater than 90° (i.e., an obtuse angle) as illustrated in FIG. 10. When the cleaner 50 has such a configuration, the cleaner can be easily inserted into the light scanning device 4. Further, when the cleaner 50 is drawn from the light scanning device 4 after the cleaning operation, the cleaning member 51 is contacted with the glass plate 48 so as to counter the glass plate, and therefore the surface of the glass plate can be well cleaned and the collected dust can be securely swept out from the light scanning device 4. Thus, an effective cleaning operation can be performed.

Figure 11A:
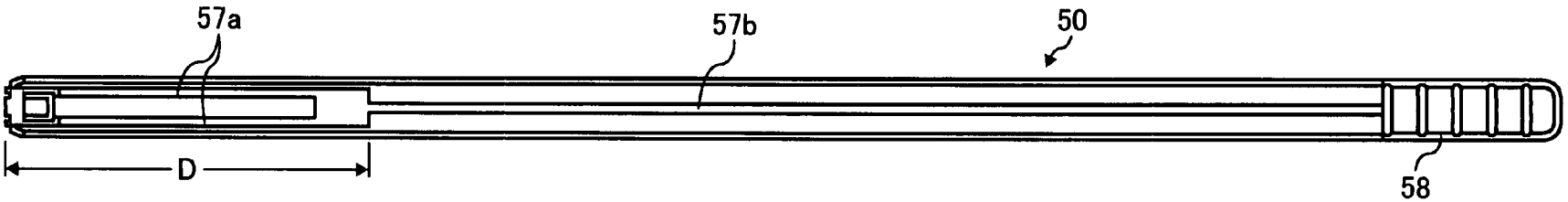
FIGS. 11A and 11B are schematic views illustrating the entire of the cleaner illustrated in FIG. 6.
Figure 11B:
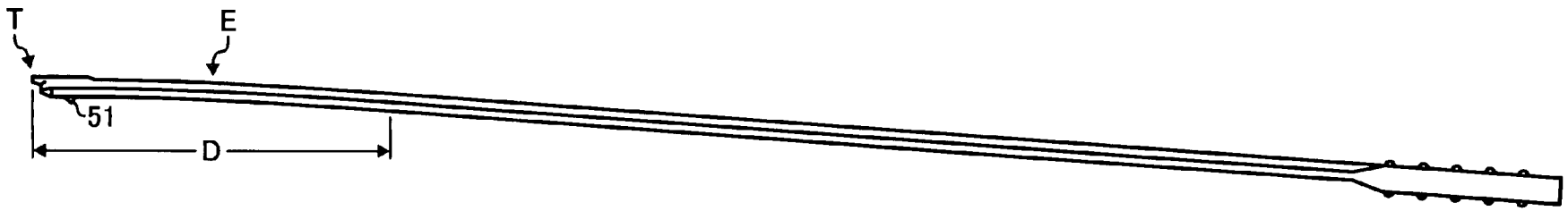

FIGS. 11A and 11B are an elevational view and a side view of the cleaner 50, respectively. Referring to FIGS. 11A and 6, double ribs 57*a* are formed on a tip portion (D) of the cleaner 50, and a single rib 57*b* is formed on the other portion of the cleaner. Therefore, the tip portion (D) has a greater rigidity than the other portion. In addition, the tip portion (D) is bent toward one side thereof, on which the cleaning member 51 is provided, as illustrated in FIG. 11B. Further, it is preferable that the distance between a center (E) of the tip portion D and a tip (T) of the cleaner 51 is longer than the interval between two adjacent L-form guides 54 illustrated in FIG. 7. Since the tip portion (D) has a higher rigidity than the other portion, the cleaner 50 can be easily inserted into the light scanning device 4 if the guide 53 is engaged with the engaging portion 55 of the light scanning device 4 as illustrated in FIGS. 6 and 7.

In addition, since the tip portion (D) of the cleaner 50 is bent and the distance between the center (E) and the tip (T) of the cleaner is longer than the interval between two adjacent L-form guides 54, the cleaning member can be contacted with the surface of the dust-proof glass plate 48 at substantially a constant pressure. Specifically, when the center (E) is located at the center between two adjacent L-form guides 54, the tip (T) of the cleaner can be pressed by the bending force of the cleaner. When the center (E) is located below one of the L-form guides 54, the tip (T) of the cleaner can be pressed by another one of the L-form guides 54. Therefore, the cleaning member 51 can be always contacted with the dust-proof glass plate 48 at substantially a constant pressure. In FIG. 11A, numeral 58 denotes a handle portion.

Thus, the surface of the dust-proof glass plate 48 can be securely cleaned well even by users. Therefore, the original performance of the light scanning device and the image forming apparatus can be maintained over a long period of time.

Even when a spherical toner is used to produce high quality images, the toner particles adhered to the glass plate can be well removed therefrom by the cleaner. Therefore, the original performance of the light scanning device and the image forming apparatus can be maintained over a long period of time. In addition, the light scanning device can be freely set in the image forming apparatus without constraints.

This document claims priority and contains subject matter related to Japanese Patent Application No. 2005-218852, filed on Jul. 28, 2005, incorporated herein by reference.

Having now fully described the invention, it will be apparent to one of ordinary skill in the art that many changes and modifications can be made thereto without departing from the spirit and scope of the invention as set forth therein.

What is claim as new and desired to be secured by Letters Patent of the United States is:

1. A light scanning device for performing laser beam scanning, comprising:

a polygon scanner configured to deflect a laser beam;

an optical device configured to guide the deflected laser beam;

a case in which the polygon scanner and the optical device are arranged;

a transparent covering member which is provided on the case to cover an opening and which transmits the laser beam to perform laser beam scanning; and a cleaner detachably attached to the light scanning device, the cleaner including a substantially straight body portion, and a tip portion extending from the body portion, the tip portion including an elastic cleaning member on one side of the tip portion for cleaning a surface of the transparent covering member, and a recessed portion on said one side, wherein an end of the tip portion farthest from the body portion is curved toward said one side relative to the body portion.

2. The light scanning device according to claim 1, wherein a longitudinal length of the cleaner is greater than a longitudinal length of the transparent covering member.

3. The light scanning device according to claim 1, wherein a width of the recessed portion is greater than a width of the elastic cleaning member.

4. The light scanning device according to claim 1, wherein a width of the recessed portion is less than a width of the transparent covering member.

5. The light scanning device according to claim 1, wherein the cleaner has a space therein so that the elastic cleaning member is stored in the space without being contacted with other portions of the cleaner when the elastic cleaning material is bent by being contacted with the surface of the transparent covering member.

6. The light scanning device according to claim 1 wherein when the cleaner is attached to the light scanning device, the cleaning member is contacted with the transparent covering member such that an angle formed by an upper surface of the cleaning member and an upper surface of the transparent covering member is greater than 90°.

7. The light scanning device according to claim 1, wherein the case comprises a plurality of guides configured to guide the cleaner when the cleaner cleans the surface of the transparent covering member, and wherein a distance between a center of the tip portion and a tip of the tip portion is longer than an interval between two adjacent guides of the plurality of guides in a direction of a sliding movement of the cleaner.

8. The light scanning device according to claim 1, wherein the tip portion has a greater rigidity than the body portion.

9. The light scanning device according to claim 8, wherein the body portion includes a rib providing rigidity, and the tip portion includes a plurality of ribs providing rigidity.

10. An image forming apparatus, comprising:

an image bearing member configured to bear an electrostatic latent image thereon;

a light scanning device configured to scan the image bearing member with a laser beam to form the electrostatic latent image on the image bearing member;

a developing device configured to develop the electrostatic latent image with a developer comprising a toner to form a toner image on the image bearing member;

a transfer device configured to transfer the toner image onto a receiving material; and a fixing device configured to fix the toner image on the receiving material, the light scanning device including a polygon scanner configured to deflect a laser beam, an optical device configured to guide the deflected laser beam, a case in which the polygon scanner and the optical device are arranged, a transparent covering member which is provided on the case to cover an opening and which transmits the laser beam to perform laser beam scanning, and a cleaner detachably attached to the light scanning device, the cleaner including a substantially straight body portion, and a tip portion extending from the body portion, the tip portion including an elastic cleaning member on one side of the tip portion for cleaning a surface of the transparent covering member, and a recessed portion on said one side, wherein an end of the tip portion farthest from the body portion is curved toward said one side relative to the body portion.

11. The image forming apparatus according to claim 10, wherein the light scanning device emits the laser beam horizontally or upwardly to scan the image bearing member with the laser beam.

12. The image forming apparatus according to claim 10, wherein the toner has a first shape factor SF-1 of from 100 to 150 and a second shape factor of from 100 to 140.

* * * * *